United States Patent [19]

Boisde et al.

[11] 3,968,735

[45] July 13, 1976

[54] CONTROL DEVICE FOR A FLUIDIC-CONTROL JACK

[75] Inventors: Gilbert Boisde, Bures-sur-Yvette; Paul Cogez, Montrouge; Jean-Michel Lachenal, Ris Orangis; Michel Lamare, Palaiseau, all of France

[73] Assignee: Commissariat a l'Energie Atomique, Paris, France

[22] Filed: Mar. 8, 1974

[21] Appl. No.: 449,528

[30] Foreign Application Priority Data

Mar. 9, 1973 France ..... 73.08507

[52] U.S. Cl. ..... 92/13.8; 92/62; 92/65; 92/110; 92/151; 91/402

[51] Int. Cl.[2] ..... F01B 7/10; F15B 15/24

[58] Field of Search ..... 92/65, 152, 151, 13.8, 92/110, 62; 91/402

[56] References Cited

UNITED STATES PATENTS

| | | | |
|---|---|---|---|
| 2,282,118 | 5/1942 | Daniel | 92/65 |
| 2,298,359 | 10/1942 | Ernst et al. | 92/65 |
| 2,714,370 | 8/1955 | Jeschke | 92/65 |
| 2,836,378 | 5/1958 | Matthews | 92/65 |

*Primary Examiner*—Paul E. Maslousky
*Attorney, Agent, or Firm*—Cameron, Kerkam, Sutton, Stowell & Stowell

[57] ABSTRACT

The ends of travel of pneumatic jacks are controlled so as to obtain signals which are directly utilizable in fluidics by means of a device comprising a main jack-piston with a hollow operating stem fitted with a plunger and a positionally-adjustable regulating stem, a main cylinder and auxiliary cylinder having control ports for driving fluid and communicating with stationary fluidic control ports, and adjustable fluidic control means actuated in dependence on the position of the regulating stem with respect to a cylindrical slide-valve.

4 Claims, 5 Drawing Figures

Figures 1, 1A:
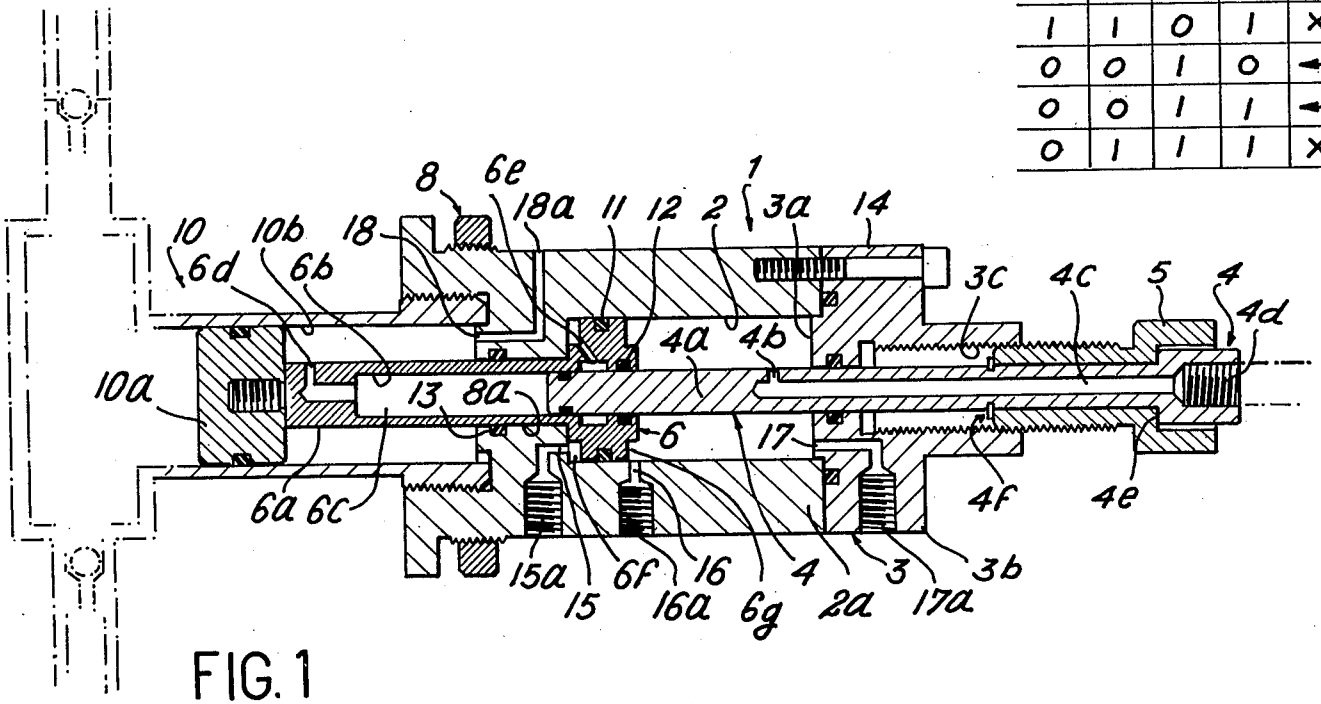

| 15a | 16a | 17a | 4d | 6 |
|---|---|---|---|---|
| 1 | 0 | 0 | 0 | ↑ |
| 1 | 1 | 0 | 0 | ↑ |
| 1 | 1 | 0 | 1 | × |
| 0 | 0 | 1 | 0 | ↓ |
| 0 | 0 | 1 | 1 | ↓ |
| 0 | 1 | 1 | 1 | × |

CONTROL DEVICE FOR A FLUIDIC-CONTROL JACK

This invention relates to the controlled operation of jacks and especially although not exclusively pneumatic jacks which are employed for the control of metering pumps.

Jacks of the single safety-release type are already known in which the end of the delivery stroke of the piston is controlled by a pneumatic signal obtained by means of a lateral opening formed in the body of the cylinder. The end of the suction stroke is usually detected by an external transducer provided in the majority of instances with a spring-loaded stop which actuates a pneumatic valve.

In the case of jacks of the double safety-release type, the means for controlling ends of travel become cumbersome and are complicated by the use of variable-travel pistons.

The aim of this invention is to provide a jack-control device which overcomes the disadvantages outlined above while permitting simple construction of the elements for controlling ends of travel together with the possibility of adjusting the range of travel of the jack as a function of the fluid delivery to be regulated by the pump.

A further object of the invention is to provide elements for controlling ends of travel so as to obtain signals which can be directly utilized in fluidics as a result of all-or-nothing discrimination of pressure.

To this end, a double-safety control device in accordance with the invention is characterized in that it comprises:

- a main piston with a hollow operating stem which emerges through a packing-gland seal of the jack,
- a plunger slidably fitted in the operating stem and having a range of travel equal to that of the main piston,
- a regulating stem which is located opposite to the plunger and the position of which can be modified with respect to a cylindrical slide-valve,
- a main cylinder and an auxiliary cylinder mounted in tandem with a distributor cylinder corresponding to the cylindrical slide-valve,
- stationary and independent control ports for the flow of a driving fluid which are placed at the two respective ends of the main cylinder and of the auxiliary cylinder,
- a fluidic control port within the interior of the main piston which communicates with the main cylinder on the side corresponding to the operating stem,
- a stationary fluidic control port which opens into the main cylinder at a distance equal to the thickness of the main piston placed at the delivery end of travel,
- a stationary fluidic control port which opens into the auxiliary cylinder at a distance equal to the thickness of the auxiliary piston placed at the end of travel of the plunger in the position corresponding to the maximum suction stroke of the main piston,
-adjustable fluidic control means actuated in dependence on the relative positions of the regulating stem and the cylindrical slide-value with respect to the auxiliary cylinder.

Double safety release is understood to refer in this context to the position-setting of the auxiliary piston which determines the variable suction and delivery strokes of the main piston which is connected to the pump piston.

In accordance with one characteristic feature of the embodiment hereinabove described, thee stationary control ports and fluidic control ports which communicate respectively with the main cylinder and with the auxiliary cylinder open into external connections of said jack.

In accordance with one embodiment which makes it possible to have significant positive fluidic information relating to the position of the auxiliary piston, the adjustable fluidic control means comprise a stationary port in the distributor cylinder, said port being controlled by the relative positions of lap between the cylindrical slide-valve and the adjustable stem, a port formed in the plunger so as to communicate with the main cylinder and via an internal passage with an external connection of said jack, a threaded bearing member on the adjustable stem which is screwed into the cylindrical slide-valve with a locking counter-nut.

In another embodiment which makes it possible to obtain significant negative fluidic information relating to the position of the auxiliary piston, the adjustable fluidic control means comprise a port formed in the adjustable stem so as to communicate through an internal passage with an external connection of said jack, an externally threaded portion of the distributor cylinder on which is screwed a manual-control sleeve which determines the laps of the cylindrical slide-valve on the adjustable stem.

An alternative form of the embodiments hereinabove set forth comprises a main piston together with a plunger at the end remote from the operating stem of said piston which penetrates within a hollow stem joined to the auxiliary piston, ports located on the operating stem and on said plunger which communicate with each other through an internal passage of said plunger, a port located near the auxiliary piston within the hollow stem which communicates with the auxiliary cylinder.

A more simple alternative form of the control device described in the foregoing makes provision for a single safety release for the suction position of the main piston. This device is characterized in that it comprises:

- a main piston with a hollow operating stem which emerges through a packing-gland seal of the jack,
- a plunger slidably fitted in the operating stem and having a range of travel equal to that of the main piston,
- a regulating stem which forms an extension of the plunger at the end remote from the operating stem and the piston of which can be modified with respect to a cylindrical slide-valve,
- a main cylinder and a slide-valve cylinder mounted in tandem,
- stationary and independent control placed for the flow of a driving fluid which are places at the two respective ends of the main cylinder,
-a fluidic control port within the interior of the main piston which communicates with the main cylinder on the side corresponding to the operating stem,
- a stationary fluidic control port which opens into the main cylinder at a distance equal to the thickness of the main piston placed at the delivery end of travel,
- adjustable fluidic control means actuated in dependence on the relative positions of the regulating stem and the cylindrical slide-valve within its cylinder.

In one embodiment of the control device having a single safety release, the adjustable fluidic control means comprise a port within the plunger which communicates with the main cylinder and through an internal passage with an external connection of said jack, a threaded bearing member on the cylindrical slide-valve which is screwed into a threaded portion of the slide-valve cylinder which determines the range of travel of the adjustable stem.

The embodiments hereinabove described in accordance with the invention are preferably applicable to pneumatic jacks but can be transposed to hydraulic jacks without any difficulty.

Figure 2:
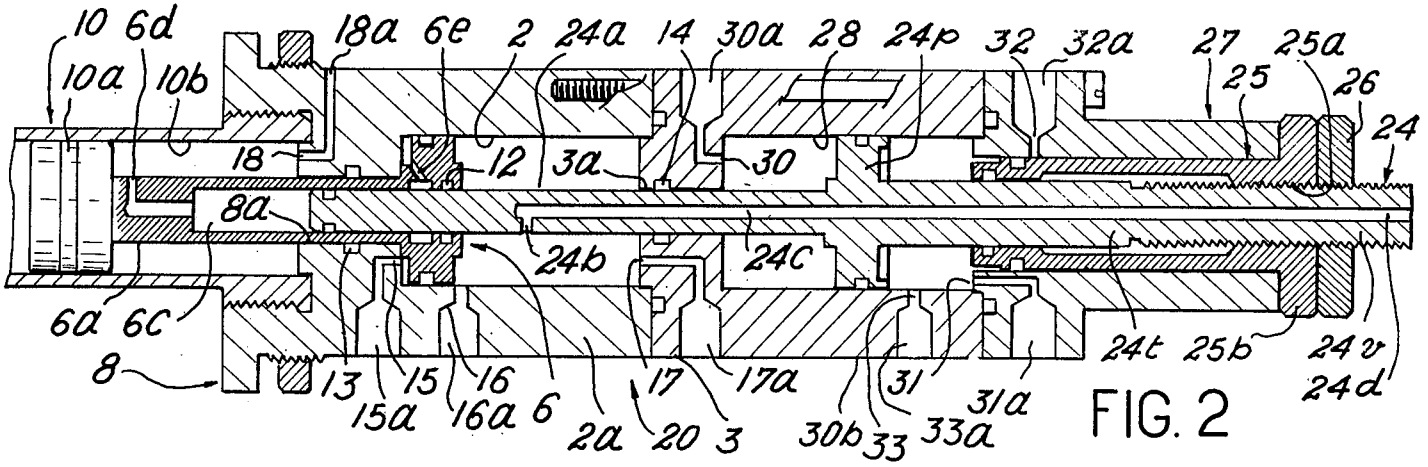
Figure 3:
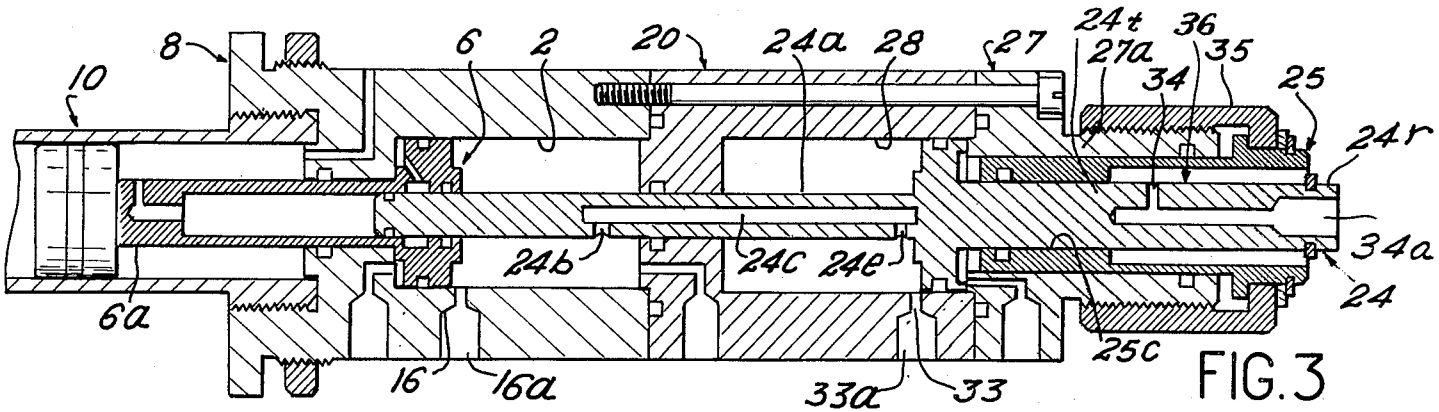
Figure 4:
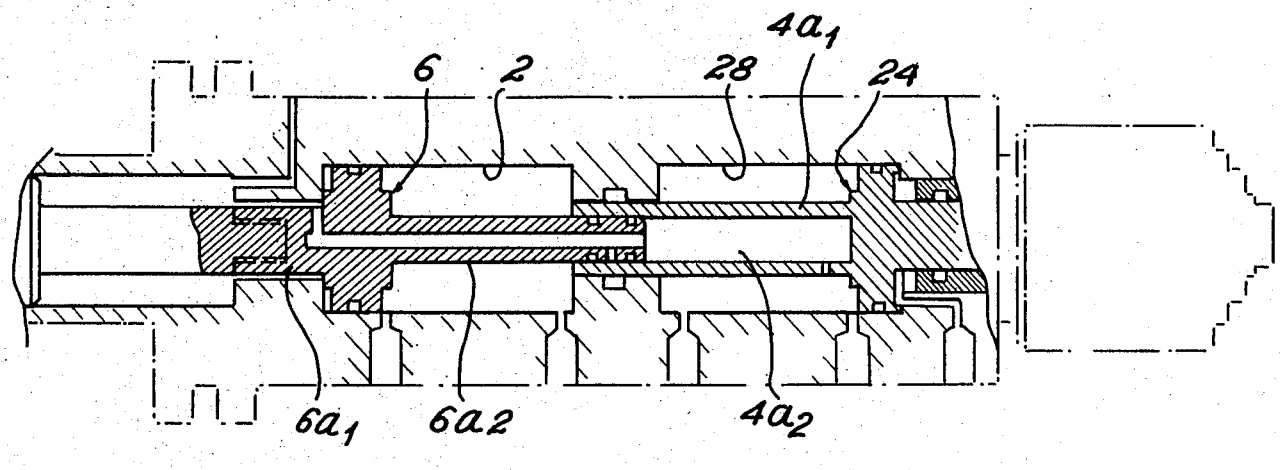

The following specification relates to non-limitative examples of construction, reference being had to the accompanying drawings, in which:

- FIG. 1 illustrates a jack of the single safety-release type;
- FIG. 1*a* is a binary-code diagram obtained by means of the jack shown in FIG. 1;
- FIG. 2 and 3 illustrate forms of construction of jacks of the double safety-release type;
- FIG. 4 is an alternative form of construction which is applicable to FIGS. 1, 2 and 3.

In order that the invention may more readily be understood, the simpler device with a single safety release will first be described with reference to FIG. 1.

In FIG. 1, the jack comprises a master cylinder 2 closed by a removable end and an axial plunger 4, the positions of which are set by means of a knurled adjusting-sleeve 5 screwed into an internally-threaded bore 3*c* having the same end portion 3. The knurled adjusting-sleeve 5 is rotatable on the plunger 4 between an annular shoulder 4*e* and a stop-ring 4*f*.

A main piston 6 placed within the master cylinder 2 has a stem 6*a* which passes through the end portion 8. The stem 6*a* as well as the piston 6 have a common bore 6*b* which slides over the axial bearing member 4. At the end remote from the piston 6, the stem 6*a* is attached in this example to the piston 10*a* of a pump 10 having a cylinder which is designated by the reference 10*b*.

Packing-rings 11 and 12 are provided in one case (11) between the main piston 6 and the master cylinder 2 and in the other case (12) between the common bore 6*b* and the plunger extension 4*a*. Further packing-rings are provided, namely a packing-ring 13 between the passage 8*a* of the end portion 8 and the stem 6*a* and a packing-ring 14 between the passage 3*a* of the end portion 3 and the plunger 4 (bearing member 4). The scope of the invention is not limited in any sense by the number of packing-rings or the positions of these latter.

The end portions 3 and 8 have stationary control ports designated respectively by the references 15 and 17 and adapted to communicate with connections disposed in one case (connection 15*a*) in the wall 2*a* of the master cylinder 2 and in the other case (connection 17) within the body 3*b* of the end portion 3. A fluidic control port 16 communicates with another connection 16*a* which is also disposed in the wall 2*a*. The port 16 is located in the wall of the cylinder 2 behind the face of the piston 6 at the end of the delivery stroke.

The cylinder 10*b* of the pump 10 communicates with free air through a discharge duct 18 and an outlet 18*a*. The stem 6*a* of the main piston 6 has a chamber 6*c* which communicates on the one hand with the cylinder 10*b* of the pump 10 via a port 6*d* and on the other hand with the master cylinder 2 via another port 6*e* formed in the main piston 6. The plunger extension 4*a* also has a duct 4*c* which communicates on the one hand with the master cylinder 2 via a fluidic control port 4*b* and on the other hand with the connection 4*d*.

The connections or end counterbores 4*d*, 15*a*, 16*a* and 17*a* are connected to pneumatic logic systems which do not form part of the invention.

Starting from the end-of-travel position of the main piston 6 as shown in FIG. 1, the operation of the single-acting jack 1 is as follows: the knurled sleeve 5 is rotated so as to displace the plunger extension 4*a* in either one direction or the other within the interior of the master cylinder 2.

This positioning operation is carried out as a result of the reaction of the knurled sleeve 5 within the threaded portion 3*c* and against the stop-ring 4*f* or the annular shoulder 4*e*.

In the respective positions of the stop-ring 4*f* and of the main piston 6 as shown in FIG. 1 and as soon as a fluid pressure is admitted through the control port 15 onto the face 6*f* of the piston 6, this latter moves towards the right-hand side of the figure and almost immediately uncovers the control port 16. The fluid contained within the master cylinder 2 escapes through the port 16. As soon as the piston 6 reaches the end of travel (on the right-hand side of FIG. 1), the port 6*e* coincides with the port 4*b* (plunger extension 4*a*) and the fluid contained within the master cylinder 2 is permitted to escape through the duct 4*c* and the connection 4*d*.

Conversely, starting from the position last mentioned (not shown in the figure) and as soon as a fluid pressure is transmitted through the control port 17, the piston moves towards the left-hand side of FIG. 1 and passes beyond the control port 4*b*, with the result that the fluid pressure is also transmitted by said port 4*b* to the connection 4*d*. As soon as the piston 6 has returned to the extreme left-hand position shown in FIG. 1, the port 16 is uncovered and the fluid pressure is transmitted to the connection 16*a*. The cycle begins again as soon as the fluid pressure is again applied to the face 6*f* of the main piston 6.

By virtue of the spacing of the ports 15 and 16, the piston 6 is always returned to the end position shown on the left-hand side of FIG. 1. In the other direction, the end position of the piston on the right-hand side (not shown in the figure) is adjusted by displacing the port 4*b*, that is to say the plunger 4. If said plunger is inwardly displaced towards the left, the port 6*e* of the piston 6 will communicate with the port 4*b* and the end-of-travel information which initiates the admission of fluid through the port 17 will be provided much earlier by the fluid which passes through said port 4*b* and the connection 4*d*.

The right-hand end-of-travel position in the case of FIG. 1 is therefore closely dependent on the relative positions of the ports 4*b* and 6*e*.

During the movement of translation of the piston 10*a* and especially during the suction stroke of the pump 10, the air which is stored in the cylinder 10*b* is discharged through the port 18 and the outlet duct 18*a*.

Interpretation of the fluidic signals with respect to the driving fluid in the ports of the jack as shown in FIG. 1 and considered by way of example is summarized in the table of FIG. 1*a*.

The successive stages of operation are indicated in binary code by 1 in the presence of a fluid pressure (actuation and control) and by 0 in the absence of pressure in the connections 4*d*, 15*a*, 16*a* and 17*a*. The arrows indicate the direction of displacement of the piston 6 and the crosses indicate the end positions of said piston.

FIG. 2 illustrates a double-acting jack 20 in which the master cylinder 2 and distribution are identical with the construction shown on the left-hand side of FIG. 1, the same reference numerals being retained in this figure with the exception of the plunger extension 4*a* which becomes 24*a*.

In this figure, the plunger 24 is provided with an auxiliary piston 24*p* which is integral with the plunger extension 24*a* and a stem 24*t* having a projecting threaded portion 24*v* which is screwed into a cylindrical slide-valve 25 and into a lock-nut 26. The slide-valve 25 is slidably mounted within a distributor cylinder 27.

An auxiliary cylinder 28 in which the plunger 24 moves has an end portion 3 which is similar to that of the single-acting jack of FIG. 1 with a stationary control port 30 and a connection 30*a*. The opposite end portion is formed by the distributor cylinder 27. A stationary control port 31 opens into the cylinder 28 and corresponds to the connection 31*a*. The position of the slide valve 25 controls the opening of a fluidic control port 32 (with connection 32*a*) which delivers fluidic logic information.

The plunger extension 24*a* has a fluidic control port 24*b* and a duct 24*c* which extends to the connection 24*d*. The construction of these components is identical with that of the plunger 4 of FIG. 1.

A stationary control port 30 (with connection 30*a*) permits the admission of a fluid pressure onto the left-hand face of the piston 24*p*.

The positions of the plunger extension 24*a* and the auxiliary piston 24*p* are dependent on the relative positions of the stem 24*t* within the cylindrical slide-valve 25 actuated by auxiliary piston 24*p*. Said positions are adjusted by means of the projecting threaded portion 24*v* which rotates within the nut 25*a* of the slide-valve 25. The lock-nut 26 maintains the position-setting which has been selected.

The double-acting jack of FIG. 2 operates in the following manner: positioning of the suction end-of-travel of the piston 10*a* of the pump 10 is carried out as a result of sliding motion of the plunger 24 under the action of a pressure of fluid introduced through the port 31 and as a result of adjustment of the cylindrical slide-valve 25 obtained by means of the projecting threaded portion 24*v*.

The (right-hand) end-of-travel position of the auxiliary piston 24*p* is controlled by control port 30 and the fluidic control port 33. The (right-hand) end-of-travel position of the main piston 6 is determined by the stroke of the stem 24*a*, that is to say by the distance of penetration of said stem into the chamber 6*c* (communication of port 6*e* with port 24*b*). The (left-hand) end-of-travel position of the auxiliary piston 24*p* is controlled by the closure of the fluidic control port 32 in cylinder 27. The (left-hand) end-of-travel position of the main piston 6 is limited by the return of this latter between the ports 15 and 16.

The operation of the main piston 6 with respect to the plunger extension 24*a* is identical with the operation of the single-acting jack 1 of FIG. 1. Moreover, the auxiliary piston 24*p* can be returned to the end-of-travel on the right-hand side of FIG. 2 by a fluid pressure applied to the left face of said piston.

FIG. 3 shows an alternative form of construction of the double-acting jack 20 in which the cylindrical slide-valve 25 is rigidly fixed to a control knob 35 which is screwed onto the body 27*a*. The fluidic control port 32 (shown in FIG. 2) is replaced by a port 34 and connection 34*a* within a projecting portion 24*r* of the plunger 24 at the end remote from the plunger extension 24*a*. The projecting end 24*r* moves within the bore 25*c* and within a cavity 36 of the slide-valve 25.

The duct 24*c* has another port 24*e* which serves to apply a fluid pressure supplied from the cylinder 2 through the port 24*b*, with the result that the port 30 of FIG. 2 can be dispensed with.

The forms of construction of the jack in accordance with FIGS. 2 and 3 permit remote control of fluid delivery to be regulated by the piston 10*a* of the pump 10 by producing action on the plunger extension 24*a*. Manual adjustment of the cylindrical slide-valve 25 permits accurate end-of-travel position settings. The fluid pressures applied to the ports permit a large number of combinations of the pneumatic logic system which is employed for initiating and controlling the operation of the jack.

The interpretation of the fluidic signals with respect to the driving fluid in the ports of the jack shown in FIG. 2 and considered by way of example is summarized in the accompanying table.

As in the table of FIG. 1*a*, the successive stages of operation are indicated in binary code by I in the presence of a fluid pressure (operation and control) and by 0 in the absence of pressure at the connections considered.

In the embodiments of FIGS. 1, 2 and 3, the plunger extension 4*a* is male and the connecting stem 6*a* is female. In another embodiment of the invention which is illustrated in FIG. 4, the plunger extension 4*a* is female with a bore $4a_2$, the stem $6a_1$ has a male extension $6a_2$ and slides within the bore $4a_2$. The ports such as 15 to 17 and 31 to 33 remain in the same positions; the ports such as 4*b*, 6*d* and 24*b*, 24*e* of FIGS. 1 to 3 are adapted (as shown in FIG. 4) to the construction of the (female) plunger $4a_1$and of the (male) stem $6a_1$. The operation of the embodiment shown in FIG. 4 is exactly the same as the previous embodiments.

The device in accordance with the invention is preferably applied to pneumatic jacks but may be transposed to hydraulic jacks without any difficulty.

TABLE

| FUNCTIONS OF JACK | 15 | 16 | 17 | 32 | 31 | 24d | 33 | 18 |
|---|---|---|---|---|---|---|---|---|
| Commencement of cycle, establishment of limitation of travel of main piston | 0 | 0 | 0 | 0 | I | 0 | 0 | 0 |
| Establishment of end-of-travel safety release on suction side of plunger | 0 | 0 | 0 | 0 | I | 0 | I | 0 |
| End-of-travel safety limitation | | | | | | | | |

TABLE-continued

| FUNCTIONS OF JACK | 15 | 16 | 17 | 32 | 31 | 24d | 33 | 18 |
|---|---|---|---|---|---|---|---|---|
| (delivery side of plunger) | 0 | 0 | 0 | I | I | 0 | I | 0 |
| Commencement of suction of the liquid by the main piston asso-coated with plunger | I | 0 | 0 | I | I | 0 | I | 0 |
| Establishment of end-of-travel safety release on delivery side of main piston | I | I | 0 | I | I | 0 | I | 0 |
| Safety release at end of suction stroke of main piston | I | I | 0 | I | I | I | I | 0 |
| Thrust of plunger, air suction stroke (retraction) | I | I | 0 | 0 | 0 | I | 0 | 0 |
| Safety release at end of suction stroke of plunger | I | I | 0 | 0 | 0 | I | I | 0 |
| Commencement of reverse movement of travel of main piston | 0 | 0 | I | 0 | 0 | 0 | 0 | 0 |
| Establishment of end-of-travel safety release on suction side of main piston | 0 | 0 | I | 0 | 0 | I | I | 0 |
| Safety release at end of delivery stroke of main piston | 0 | I | I | 0 | 0 | I | I | 0 |

What we claim is:

1. A control device for a pneumatic double acting jack (20) for the operation of a proportioning pump comprising a main piston (6), a hollow operating stem (6*a*) for said main piston extending from the jack (20) and moveable between extreme inner and outer positions, an auxiliary piston (24*p*) having inner and outer positions equal to those of said main piston (6), a piston extension (24*a*) connected to said auxiliary piston (24*p*) and sliding in said hollow operating stem (6*a*), a shaft (24*t*) connected to said auxiliary piston, a slide valve (25) surrounding said shaft (24*t*), means (25*a*) for adjusting the relative positions of said shaft (24*t*) and slide valve (25), a master cylinder (2) receiving said main piston (6), an auxiliary cylinder (28) receiving said auxiliary piston (24*p*), a distributor cylinder (27) opening into said auxiliary cylinder (28), said slide valve (25) sliding in said distributor cylinder (27) together with said shaft (24*t*) for limited movement when said slide valve (25) engages said distributor cylinder (27), fixed and independent control ports (15, 17, 30, 31) for the passage of a motor fluid respectively disposed at the two extremities of said main cylinder (2) and of said auxiliary cylinder (28), a fluidic control port (6*e*) in said main piston (6) opening on said piston extension (24*a*), a port (24*b*) in said piston extension (24*a*) cooperating with said fluidic control port (6*e*), a fluidic control port (16) opening into said main cylinder (2) at a distance equal to the thickness of said main piston (6) from its outer position, a fluidic control port (33) opening into said auxiliary cylinder (28) at a distance equal to the thickness of said auxiliary piston (24*p*) from its inner position for moving said main piston (6) into its extreme inner position and a fluidic control port (32) in said distributor cylinder (27) opening into said auxiliary cylinder (28) and opened and closed by said slide valve (25) subject to said adjusting means (25*a*).

2. A device according to claim 1, wherein the stationary control ports and fluidic control ports which communicate respectively with the main cylinder and with the auxiliary cylinder open into external connections (15*a*, 17*a*, 30*a*, 31*a*, 32*a*) of said jack (20).

3. A control device as described in claim 1, further including a duct (24*c*) in said piston extension (24*a*), said auxiliary piston (24*p*) and said shaft (24*t*) and an outer connection (24*d*) of the jack, said port (24*b*) opening into said duct (24*c*).

4. A control device as described in claim 1, said shaft (24*t*) having a threaded extension (24*v*) screwed into said housing (25) and a locknut (26) mounted on said threaded extension (24*v*).

* * * * *